US007204118B2

(12) United States Patent
Wiens et al.

(10) Patent No.: US 7,204,118 B2
(45) Date of Patent: Apr. 17, 2007

(54) HEMMING TOOL DIE ASSEMBLY

(75) Inventors: Philip V. Wiens, LaSalle (CA); Keller McGaffey, Fenton, MI (US); Darius Gheorghita, Belle River (CA); Kenneth St. Denis, Tecumseh (CA); Gabor Sztvorecz, Windsor (CA); Dominique Baulier, St. Clair Beach (CA)

(73) Assignee: Valiant Corporation, Windsor, Ontario (CA)

( * ) Notice: Subject to any disclaimer, the term of this patent is extended or adjusted under 35 U.S.C. 154(b) by 99 days.

(21) Appl. No.: 11/206,584

(22) Filed: Aug. 18, 2005

(65) Prior Publication Data

US 2006/0037377 A1 Feb. 23, 2006

Related U.S. Application Data

(60) Provisional application No. 60/602,984, filed on Aug. 19, 2004.

(51) Int. Cl.
*B21D 39/02* (2006.01)

(52) U.S. Cl. ..... 72/315; 72/312; 72/452.1; 29/243.58

(58) Field of Classification Search ..... 72/312–315, 72/452.9, 452.8, 452.1; 29/243.58, 243.57
See application file for complete search history.

(56) References Cited

U.S. PATENT DOCUMENTS 3,143,095 A * 8/1964 Tribe ..... 29/243.58
6,079,250 A 6/2000 Scannell et al. ..... 72/381

FOREIGN PATENT DOCUMENTS

| | | | |
|---|---|---|---|
| JP | 54104476 | | 8/1979 |
| JP | 3155418 | | 7/1991 |
| JP | 03230821 | | 10/1991 |
| JP | 04059140 | | 2/1992 |
| JP | 04266433 | | 9/1992 |
| JP | 08108220 | | 4/1996 |
| JP | 8-117876 | * | 5/1996 |
| JP | 8-155564 | * | 6/1996 |
| JP | 2005-5118852 A | * | 5/2005 |
| WO | WO 95/32065 | | 11/1995 |

* cited by examiner

*Primary Examiner*—Daniel C. Crane
(74) *Attorney, Agent, or Firm*—Gifford, Krass, Sprinkle, Anderson & Citkowski, P.C.

(57) ABSTRACT

A hemming die tool assembly for use with an anvil supporting a workpiece to be hemmed. A mounting plate is pivotally secured about an axis relative to the anvil while a vertical slide is slidably attached to the mounting plate along a first direction. An elongated channel is attached to the vertical slide so that the axis of the channel is transverse to the first direction. A hemming tool is secured to the vertical slide while a rocker arm is pivotally secured at one end to the mounting plate about the pivotal axis of the mounting plate while a second end of the rocker arm is longitudinally slidably mounted in the channel. A first cam assembly pivots the mounting plate between a retracted position, in which the hemming tool is positioned away from the workpiece, and an extended position in which the hemming tool overlies the workpiece. A second cam assembly pivots the rocker arm about its pivotal axis and, in doing so, vertically displaces the vertical slide relative to the mounting plate to perform the prehemming operation.

7 Claims, 5 Drawing Sheets

HEMMING TOOL DIE ASSEMBLY

RELATED APPLICATION

This application claims priority of U.S. Provisional Patent Application Ser. No. 60/602,984 filed Aug. 19, 2004, which is incorporated herein by reference.

BACKGROUND OF THE INVENTION

I. Field of the Invention

The present invention relates generally to hemming tools for performing a hem between two metal panels.

II. Description of Related Art

In the automotive industry, hemming machines are conventionally used to attach two metal panels together. These metal panels include, for example, the metal panels to form the automotive hood, door panels, quarter panels and the like.

In one type of previously known hemming machine, the outer panel is mounted on a nest and includes an almost perpendicularly upwardly extending flange formed about its outer periphery. The inner panel is then positioned on top of the outer panel and within the flange.

In order to hem the two metal panels together, typically the entire hemming operation is performed in two steps, namely a prehemming step and a final hemming step. These two operations can be either performed in two totally separate sequences by a specific hemmer, or on the fly during the single stroke of an actuator. The first method allows a perfect control of both prehemming speed and stroke orientation, but is by nature more time consuming. The second method, generally implemented on a classical vertical press, uses a cam-activated linkage system to move in and out on the fly the prehemmed steel just before the impact of the final hem. This cycle time efficient method, however, imposes a compromise in the way the prehemming operation is achieved, especially the orientation of the prehemming stroke. A single linkage mechanism is generally used to generate a curvilinear motion of the prehem steel, impacting on the side the flange to be prehemmed. This side impact causes in turn an excessive creep of the panel during prehemming.

Such excessive creep results in an unacceptable panel construction in situations, such as the automotive industry, which demand high quality standards of its formed body panels.

There are other types of hemming machines that are used in the automotive industry. These other types of hemming machines include both a tabletop hemmer as well as a roller hemmer. However, both the tabletop and roller hemmer disadvantageously require long cycle time thus resulting in low throughput for the hemming machine. Such long cycle times are sometimes unacceptable in automotive industry large volume production.

SUMMARY OF THE PRESENT INVENTION

The present invention provides a hemming machine which overcomes all of the above-mentioned disadvantages of the previously known machines and is particularly suitable for use in performing a prehemming operation on the panels.

In brief, the present invention is provided for use with a nest which supports the workpiece to be hemmed. The workpiece, as is conventional, includes an outer panel having a flange formed about its outer periphery and an inner panel positioned within the flange on the outer panel.

A mounting plate is pivotally secured about an axis relative to the anvil. This mounting plate is pivotal between a retracted position and an extended position.

A vertical slide is slidably attached to the mounting plate so that the vertical slide is movable relative to the mounting plate along a first direction. In addition, an elongated channel is attached to the vertical slide so that the axis of the channel extends in a direction transverse, and preferably perpendicular, to the direction of movement between the mounting plate and vertical slide.

A hemming tool, and preferably a prehemming tool, is secured to the vertical slide. Moreover, when the mounting plate is in its retracted position, the hemming tool is retracted from the outer periphery of the workpiece. Conversely, as the mounting plate is pivoted to its extended position, the hemming tool overlies the flange to be hemmed.

A rocker arm is pivotally secured at one end to the mounting plate about the pivotal axis between the mounting plate and the workpiece. A second end of the rocker arm is longitudinally slidably mounted in the channel. Preferably, a roller is rotatably attached to the second end of the rocker arm for spotting movement of the second end of the rocker arm along the channel.

In operation, and assuming that a workpiece is supported on the nest, a cam actuator is then moved relative to the mounting plate along a generally vertical axis. A first cam surface on the actuator engages a cam follower on the mounting plate to pivot the mounting plate from its retracted position and to its extended position. Thereafter, and with the mounting plate maintained in its extended position by a dwell on the first cam surface, a second cam surface on the actuator engages a cam follower on the rocker arm to pivot the rocker arm between a first and second pivotal position.

As the rocker arm pivots between its first and to its second position, the coaction between the second end of the rocker arm and the channel drives the vertical slide with its attached prehemming tool from an upper and to a lower position. In doing so, the hemming tool engages the flange on the outer panel supported by the nest to perform the hemming operation.

A primary advantage of the hemming machine of the present invention is that the direction of the prehemming operation is not anymore sideways but purely vertical. Consequently, accurate control of the flange bending process during the prehemming operation enables the hemming machine to perform the hemming operation without excessive creep, achieving a much higher hem profile quality, free of distortion on outer panel exposed surface.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
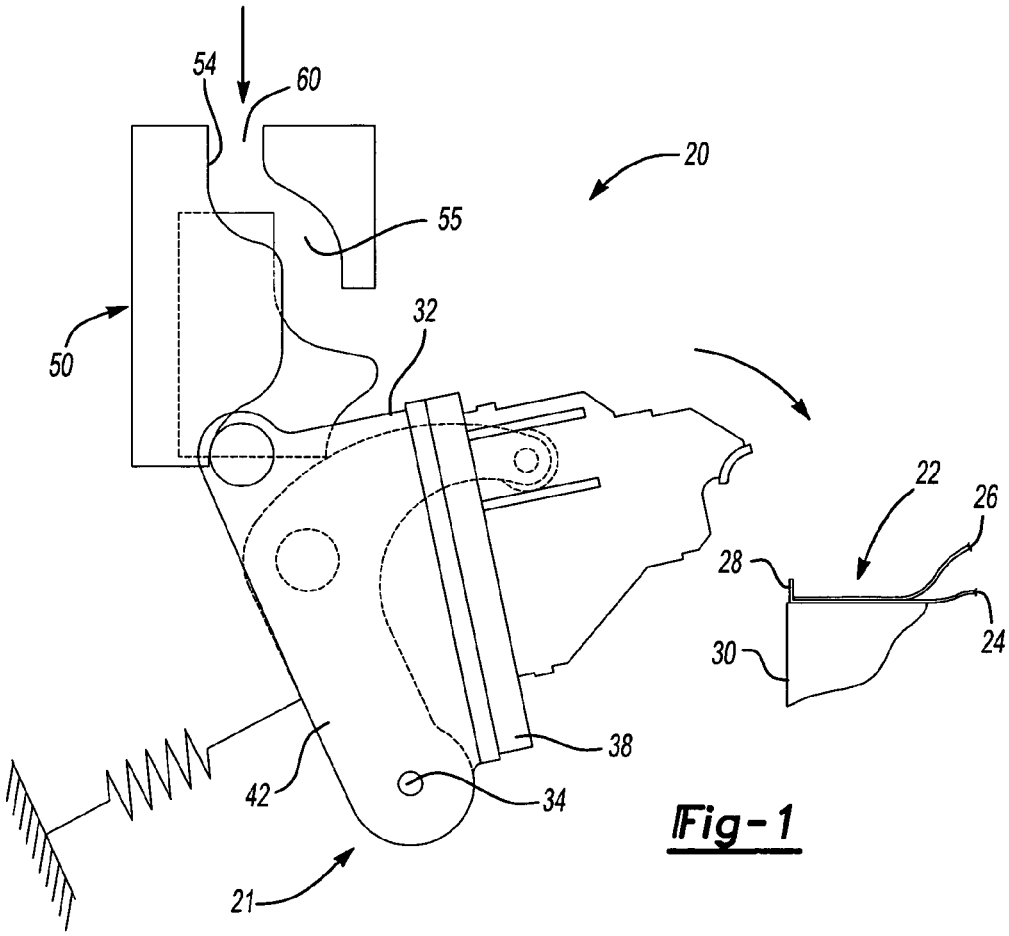
FIG. 1 is a diagrammatic side view illustrating the preferred embodiment of the hemming machine of the present invention with the hemming tool in a retracted position.
Figure 2:
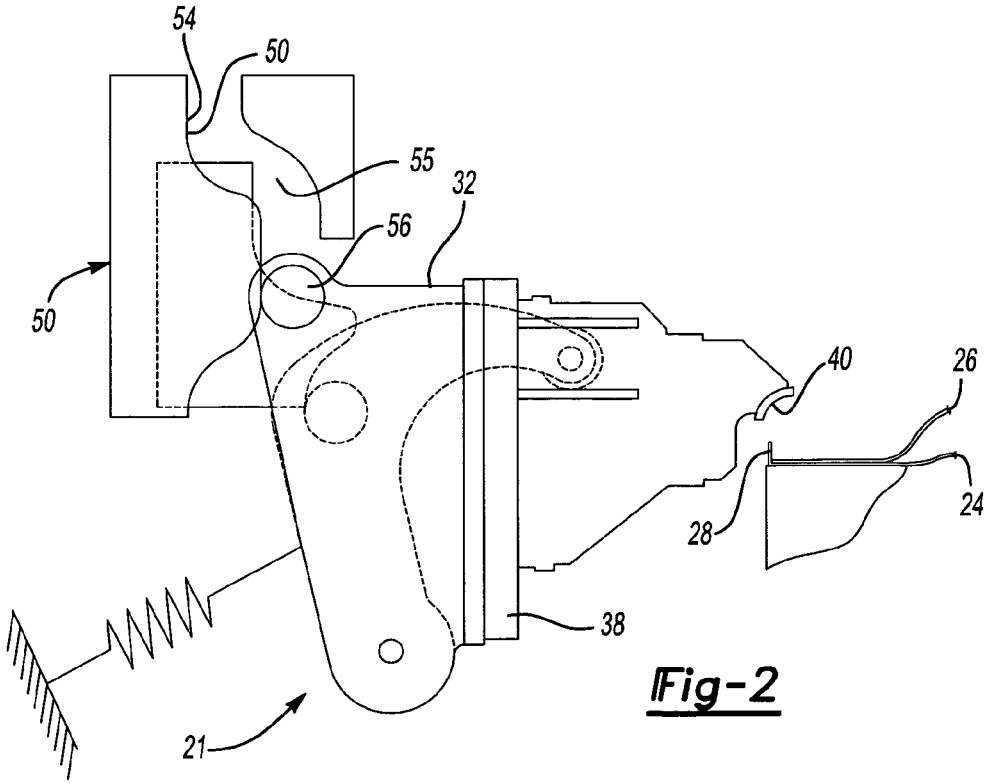
FIG. 2 is a view similar to FIG. 1, but illustrating the hemming tool in a first extended position.

With reference first to FIGS. 1 and 2, a preferred embodiment of the prehemming device 20 of the present invention is shown for performing a prehem on a workpiece 22. In a conventional fashion, the workpiece 22 comprises an outer metal panel 24 and an inner metal panel 26. An almost perpendicular flange 28 is formed about the outer periphery of the outer panel 24. In addition, the inner panel 26 is positioned on top of the outer panel 24 so that the outer edge of the inner panel 26 is positioned just at flange 28 root. The entire workpiece 22, in turn, is supported on a nest 30.

The prehemming device 20 includes a mounting plate 32 which is pivotal about an axis 34 relative to the nest 30. The mounting plate 32 is pivotal from a retracted position, illustrated in FIG. 1, and an extended position, illustrated in FIG. 2.

Figure 3:
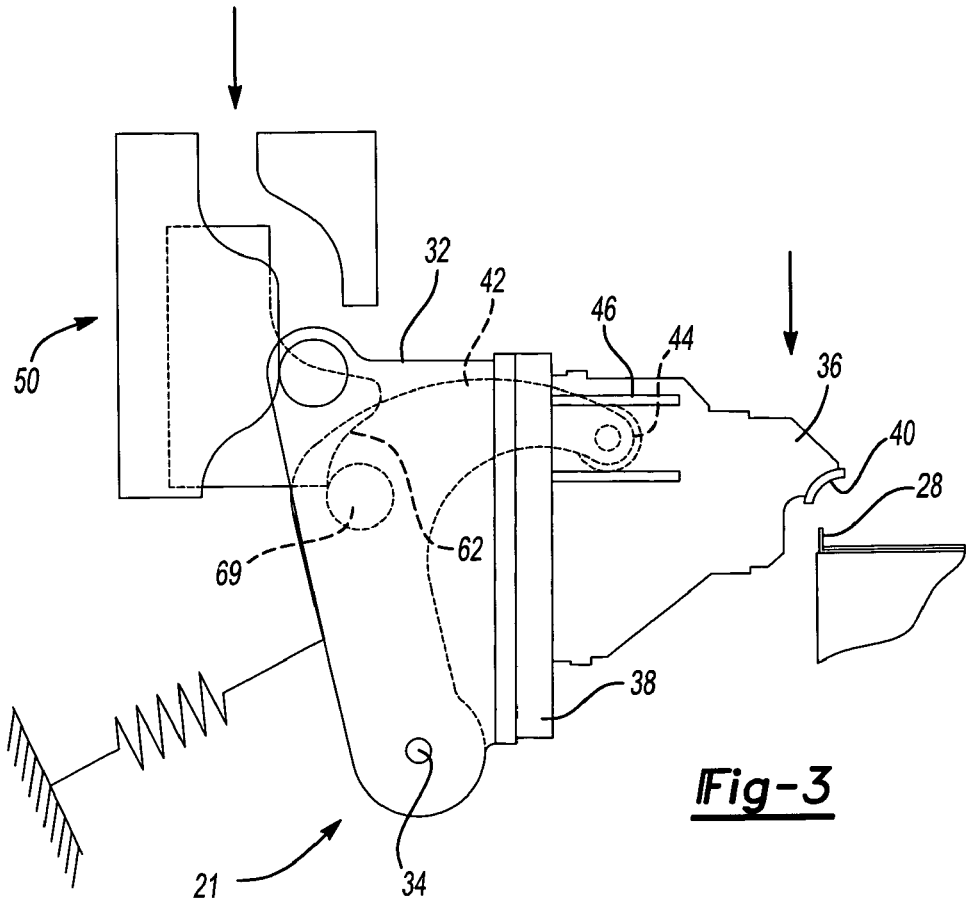
FIG. 3 is a view similar to FIG. 2 and illustrating the initiation of the second extended position: vertical movement of the hemming tool to perform the hemming operation.
Figure 4:
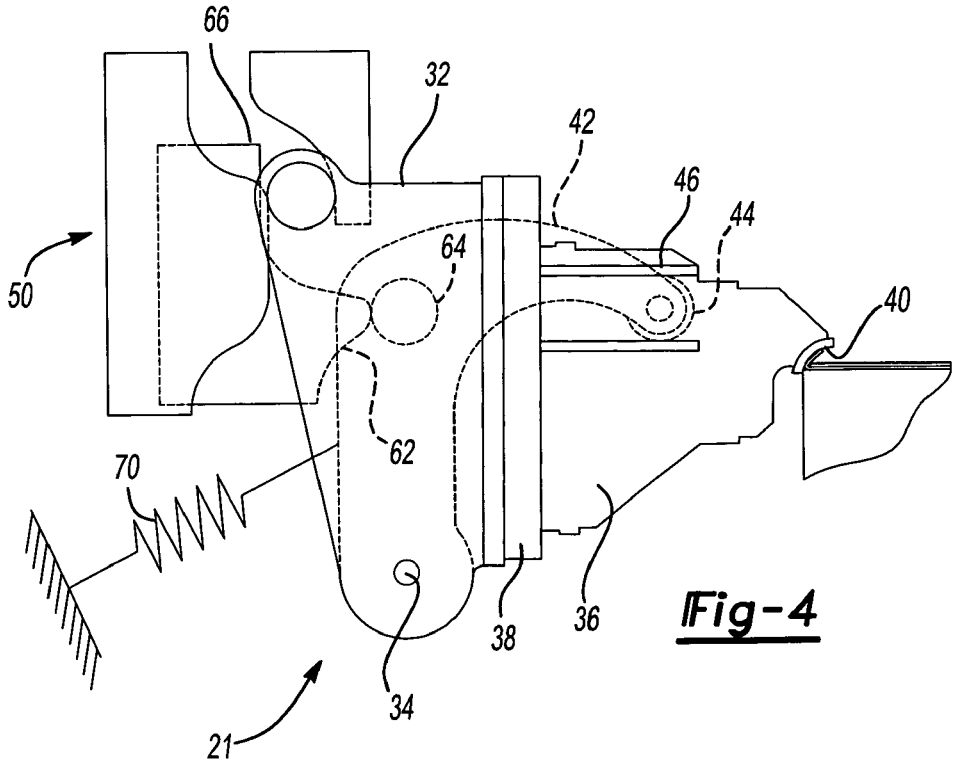
FIG. 4 is a view similar to FIG. 3, but illustrating the hemming machine at the end of the prehem forming stroke.

Referring now particularly to FIGS. 3 and 4, a vertical slide 36 is vertically slidably mounted to the mounting plate 32 between an upper position, illustrated in FIG. 3, and a lower position, illustrated in FIG. 4. Any conventional means may be used to slidably mount the vertical slide 36 to the mounting plate 32 such as a t-slide assembly 38.

A prehemming tool 40 is fixedly mounted to the vertical slide 36. The prehemming tool 40 is positioned directly above the flange 28 prior to the prehemming operation as shown in FIG. 3. As the vertical slide 36 is driven downwardly relative to the mounting plate 32 in a fashion to be subsequently described, the prehemming tool 40 contacts and bends the flange 28 to perform the prehem in the desired fashion.

Figure 9:
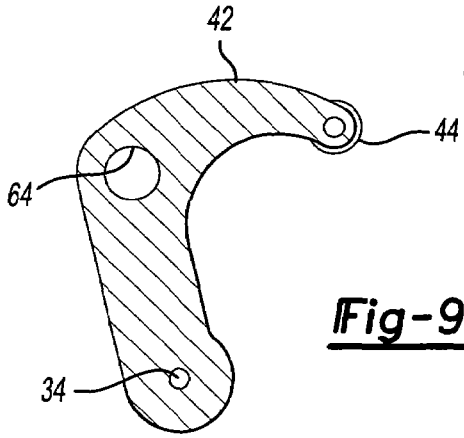
FIG. 9 is a side sectional view illustrating one component of the present invention: the rocker arm.

Referring now to FIGS. 3, 4 and 9, a rocker arm 42 is pivotally mounted at one end about the pivot point 34 to the mounting plate 32. A roller 44, in turn, is rotatably mounted to the opposite end of the rocker arm 42.

The roller 44, in turn, is longitudinally slidably mounted within a channel 46 attached to the vertical slide 36. Consequently, as the rocker arm 42 pivots from its first position, illustrated in FIG. 3, and its second position, illustrated in FIG. 4, the coaction between the roller 44 and the channel 46 vertically displaces the vertical slide 36 with its attached prehemming tool 40 from its upper position illustrated in FIG. 3 and to its lower position illustrated in FIG. 4.

Figure 6:
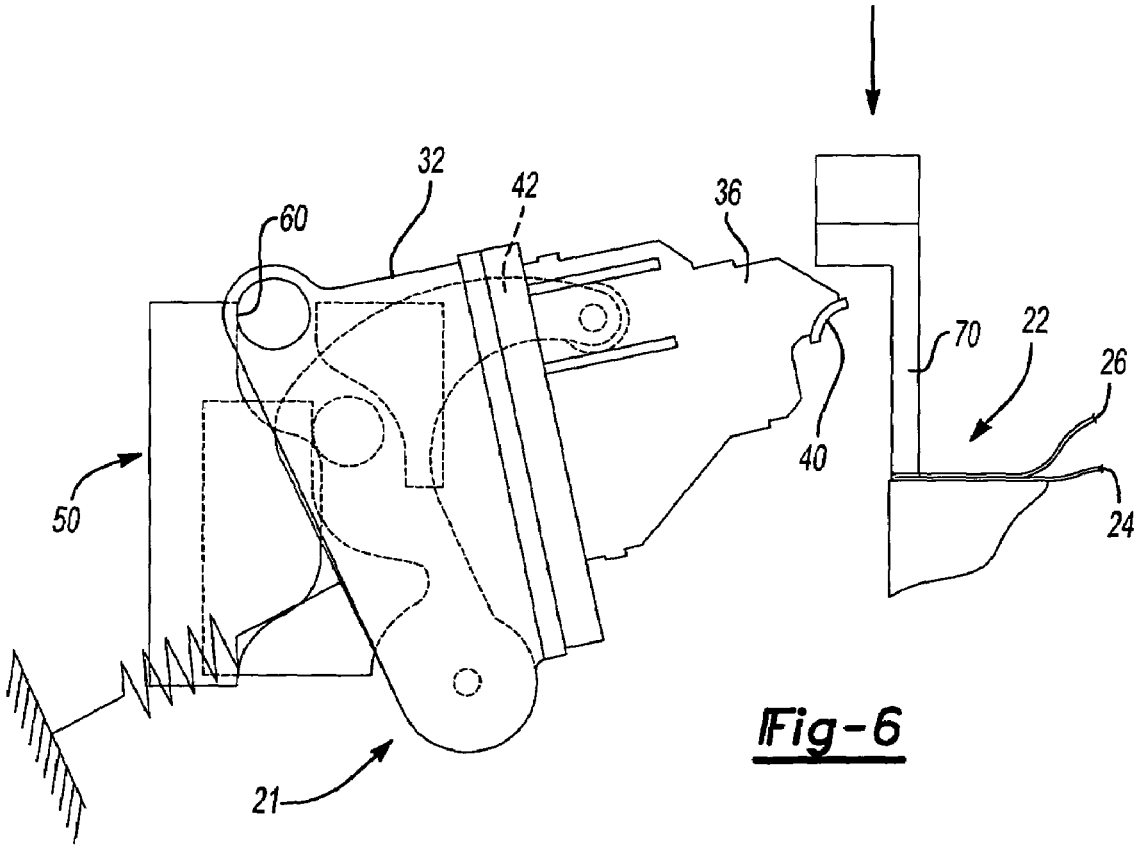
FIG. 6 is a diagrammatic view illustrating the final hemming operation performed after prehem tool full retraction.
Figure 7:
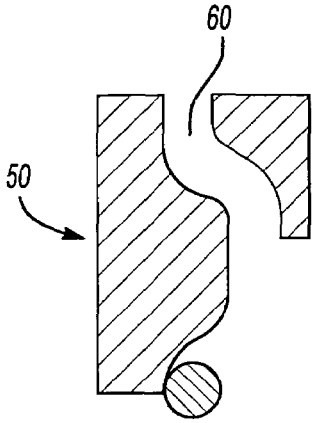
FIG. 7 is a side diagrammatic view of a first cam assembly for pivoting the hemming tool from its retracted and to its extended position.
Figure 8:
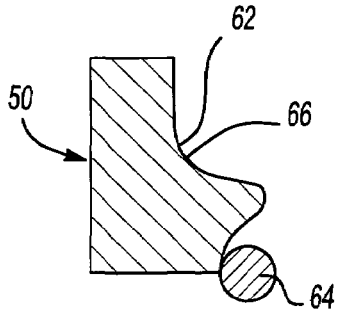
FIG. 8 is a view similar to FIG. 7, but illustrating a second cam assembly for vertically displacing the hemming tool during the hemming operation.
Figure 11:
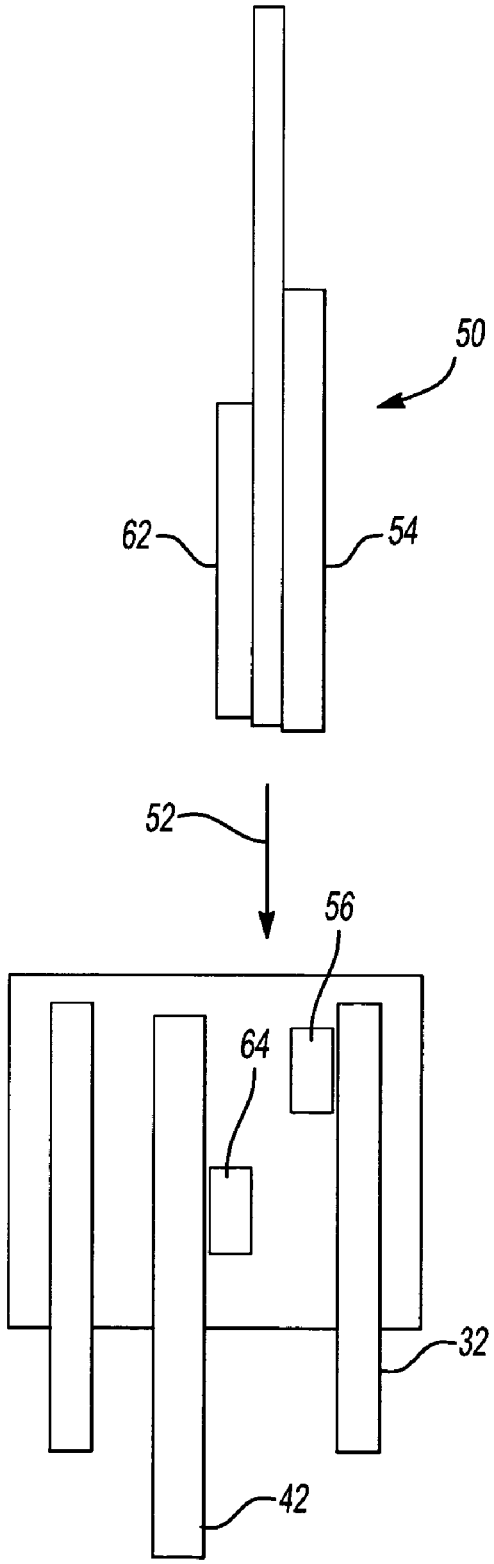
FIG. 11 is a view taken substantially along line 11—11 in FIG. 10, showing the arrangement of the two different cam plans, enlarged for clarity.

With reference now to FIGS. 1, 7 and 11, a cam actuator 50 is longitudinally movable relative to the prehemming tool assembly as illustrated at arrow 52 in FIG. 11. The cam actuator 50 includes a first cam surface 54 which abuts against a cam follower 56 mounted to the mounting plate 32 as the actuator 50 is longitudinally displaced relative to the prehemming tool assembly. Furthermore, as best shown in FIGS. 1 and 2, a cam surface 54 is configured so that the interaction between the cam surface 54 and the cam follower 56 pivots the mounting plate 32 from its retracted and to its extended position during a first portion of travel of the cam actuator 50 relative to the prehemming tool assembly. Conversely, an upper portion 60 of the cam surface 54 pivots the mounting plate 32 from its extended position (FIG. 2) and to its retracted position (FIGS. 1 and 6) during the continued longitudinal displacement of the cam actuator 50 relative to the prehemming tool assembly.

Referring now to FIGS. 3, 4, 8 and 11, the actuator 50 also includes a second cam surface 62. This second cam surface 62 is aligned with and engages a second cam follower 64 which is mounted to the rocker arm 42 at a position spaced from its pivot point 34. Consequently, as the cam actuator 50 moves from the position shown in FIG. 3 and to the position shown in FIG. 4, the coaction between the second cam surface 62 and cam follower 64 pivots the rocker arm 42 from its first position, illustrated in FIG. 3, and to its second position, illustrated in FIG. 4. This pivotal action of the rocker arm 42 vertically displaces the vertical slide from its upper position, illustrated in FIG. 3, and to its lower position, illustrated in FIG. 4, in the previously described fashion.

Figure 5:
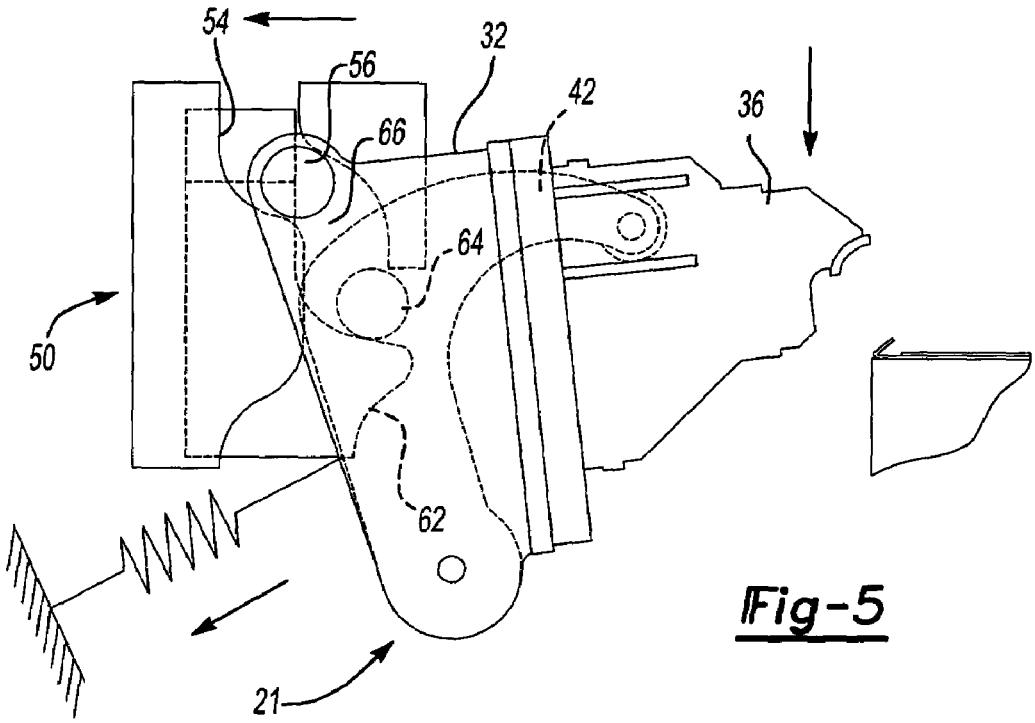
FIG. 5 is a view similar to FIG. 4, but illustrating the hemming machine in the middle of prehem tool retraction before final hemming.

The second cam surface 62 also includes an upper portion 66 which pivots the rocker arm 42 from the position shown in FIG. 4 and to the position shown in FIG. 5 during continued reciprocation of the actuator 50. A spring 70 maintains contact between the rocker arm cam follower 64 and the cam surface 62, as well as the prehemming device in full retracted position when the cam actuator 50 is far away (part loading).

The operation of the prehemming device of the present invention will now be described. With reference first to FIG. 1, the workpiece panels 24 and 26 are positioned on the nest 30. At this time, the cam actuator 50 is even far away up from the longitudinal position relative to the prehemming assembly 21 as shown in FIG. 1, in order to facilitate the workpiece loading. At this time, the mounting plate 32 is in its retracted position and, simultaneously, the rocker arm 42 is in its first position.

With reference now to FIG. 2, upon downward movement of the cam actuator 50 relative to the prehemming assembly 21, the first cam surface 54 engages the cam follower 56 on the mounting plate 32 and pivots the mounting plate 32 to its extended position shown in FIG. 2. In doing so, the prehem tool 40 is positioned vertically above the flange 28 on the workpiece outer panel 24.

With reference now to FIGS. 3 and 4, upon the further downward movement of the cam actuator 50 relative to the prehemming assembly 21, the second cam surface 62 on the cam actuator 50 engages the second cam follower 64 on the rocker arm 42 and pivots the rocker arm 42 from the position shown in FIG. 3 and to the position shown in FIG. 4. In doing so, the prehemming tool 40 is compressed against the flange 28 with a pure vertical motion thus forming the prehem.

With reference now to FIGS. 5 and 6, the continued linear displacement of the cam actuator 50 relative to the prehemming tool assembly 21 returns the mounting plate 32 to its retracted position due to the coaction between the cam follower 56 and the cam surface 54. Similarly, the coaction between the second cam follower 64 and the second cam surface 62 returns the vertical slide 36 to its upper position relative to the mounting plate 42.

Figure 10:
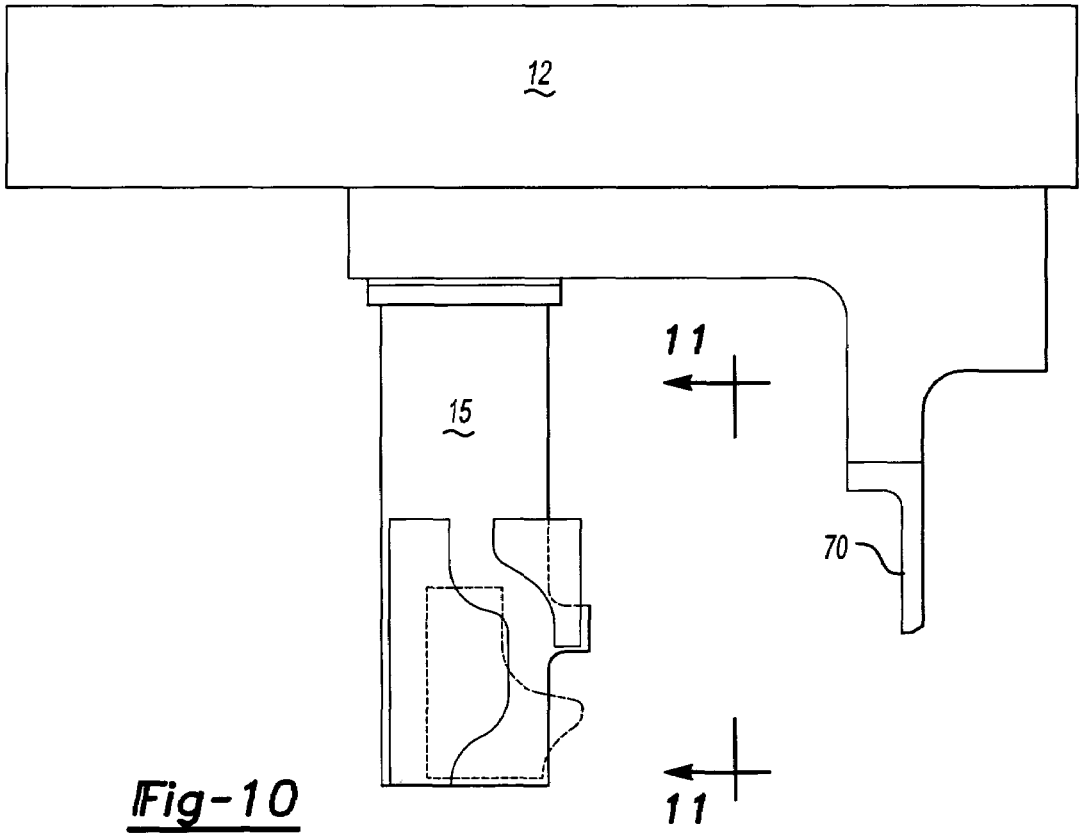
FIG. 10 is a front view illustrating a preferred embodiment of the present invention.

Following the hemming operation, a final hem can be performed using a final hemming tool 70 illustrated diagrammatically in FIGS. 6 and 10. Furthermore, during this final hemming operation, the prehemming tool 40 is retracted outwardly away from the workpiece 22 to permit access to the workpiece 22 by the final hemming tool 70.

From the foregoing, it can be seen that the present invention provides a simple and yet highly effective apparatus for performing a prehem between two metal panels. Furthermore, the speed of forming the prehem between the two metal panels may be easily controlled by controlling the speed of displacement between the actuator and the prehemming assembly. This, in turn, allows creep to be easily maintained and essentially eliminated.

Having described our invention, however, many modifications thereto will become apparent to those skilled in the art to which it pertains without deviation from the spirit of the invention as defined by the scope of the appended claims.

We claim:

1. A hemming die tool assembly for use with a nest supporting a workpiece comprising:

a mounting plate pivotally secured about an axis relative to the nest, a vertical slide slidably attached to said mounting plate along a first direction, an elongated channel attached to said vertical slide and extending in a second direction transverse to said first direction, a hemming tool secured to said vertical slide, a rocker arm pivotally secured at one end to said mounting plate about said axis, a second end said rocker arm longitudinally slidably mounted in said channel, a first cam assembly which pivots said mounting plate between an extended and a retracted position, a second cam assembly which, with said mounting plate in said extended position, pivots said rocker arm between a first and second position to thereby move said vertical slide and said prehem tool along said first direction.

2. The invention as defined in claim 1 wherein said first direction and said second direction are perpendicular to each other.

3. The invention as defined in claim 1 wherein said vertical slide can be either brought purely vertical or almost perpendicular to the surface of the workpiece to be hemmed, when said mounting plate is pivotally engaged.

4. The invention as defined in claim 1 wherein said first cam assembly comprises a cam actuator having a first cam surface and a cam follower in abutment with said first cam surface and mounted to said mounting plate.

5. The invention as defined in claim 4 wherein said second cam assembly comprises a second cam surface on said actuator and a second cam follower mounted to said rocker arm and in abutment with said second cam surface.

6. The invention as defined in claim 1 and comprising a roller rotatably attached to said second end of said rocker arm, said roller being positioned in said channel.

7. The invention as defined in claim 1 wherein said hemming tool comprises a prehemming tool.

* * * * *